US005528469A

United States Patent [19]

Todd, Jr.

[11] Patent Number: 5,528,469

[45] Date of Patent: Jun. 18, 1996

[54] LIGHT ASSEMBLY FOR A CEILING FAN

[76] Inventor: Alvin E. Todd, Jr., 3360 Progress Hill Blvd., Pigeon Forge, Tenn. 37863

[21] Appl. No.: 301,658

[22] Filed: Sep. 7, 1994

[51] Int. Cl.[6] ..... F21V 33/00

[52] U.S. Cl. ..... 362/96; 362/216; 362/294

[58] Field of Search ..... 362/96, 216, 294, 362/404, 405; 416/5; 403/367, 372, 222

[56] References Cited

U.S. PATENT DOCUMENTS

| | | | |
|---|---|---|---|
| 2,784,988 | 3/1957 | Banchback | 403/222 |
| 3,735,329 | 5/1973 | Funabashi et al. | 362/405 |
| 4,064,427 | 12/1977 | Hansen et al. | 362/96 |
| 4,356,535 | 10/1982 | Chu | 362/216 |
| 4,657,485 | 4/1987 | Hartwig | 362/96 |
| 4,685,038 | 8/1987 | Huang | 362/294 |
| 4,796,166 | 1/1989 | Greenberg | 362/96 |
| 5,028,206 | 7/1991 | Kendregan et al. | 416/5 |
| 5,072,341 | 12/1991 | Huang | 362/96 |
| 5,082,422 | 1/1992 | Wang | 416/5 |
| 5,195,870 | 3/1993 | Liu | 362/96 |

*Primary Examiner*—Denise L. Gromada
*Assistant Examiner*—Y. Quach
*Attorney, Agent, or Firm*—Pitts & Brittian

[57] ABSTRACT

A light assembly for securing to a ceiling fan. The light assembly includes a plurality of support arms, the first ends of which are secured to the ceiling fan via a securing device. The second end of each of the support arms supports an illuminating unit.

1 Claim, 6 Drawing Sheets

LIGHT ASSEMBLY FOR A CEILING FAN

TECHNICAL FIELD

This invention relates to the field of ceiling fans and more specifically to light assemblies mounted on a ceiling fan.

BACKGROUND ART

Ceiling fans are widely used in homes to decorate the home as well as provide ventilation. Typically, ceiling fans are installed by removing an existing light fixture and replacing it with a ceiling fan resulting in a decrease in light available for illuminating a room. Often, ceiling fans are provided with lights which utilize incandescent light bulbs. The light that an incandescent bulb provides may be insufficient and not able to sufficiently illuminate a larger room. Therefore, it desirable to provide a light assembly which can be secured to ceiling fan for providing sufficient light which is able to illuminate a larger room.

Typical of the art are those devices disclosed in the patents listed below.

| U.S. Pat. No. | Inventor | Date |
|---|---|---|
| 4,064,427 | Hansen et al. | Dec. 20, 1977 |
| 4,796,166 | Greenberg | Jan. 3, 1989 |
| 5,028,206 | Kendregan et al. | Jul. 2, 1991 |
| 5,072,341 | Huang | Dec. 10, 1991 |
| 5,082,422 | Wang | Jan. 21, 1992 |

U.S. Pat. No. 4,064,427 discloses a safety guard and light fixture attachment for a ceiling fan wherein individual lamp lights are secured to the outer surface of a guard. The guard surrounds the fan blades and is suspended from the ceiling plate and ceiling. The safety guard and light fixture attachment is complex and not easily secured to the existing ceiling fan.

U.S. Pat. No. 4,796,166 discloses a halogen spotlight assembly for a ceiling fan wherein the spotlight assembly is mounted on the ceiling fan and extends below the fan blades.

U.S. Pat. No. 5,028,206 discloses an illuminated ceiling fan wherein the neon tubes are secured to the outer periphery of each of the rotating blades. The neon tubes provide a limited amount of light due to their small size. Further, the neon tubes are fixed to the fan blades such that the tubes rotate with the fan blades which may result in an erratic light pattern.

U.S. Pat. No. 5,072,341 discloses a lamp assembly in which individual light units are secured to each fan blade. The light units rotate which may result in an erratic light pattern.

U.S. Pat. No. 5,082,422 discloses an illuminative fan wherein a plurality of light emitting diodes are disposed on each fan blade which are capable being flashed or colored to produce a variety of effects. The intention is to provide an erratic light pattern for decoration and not to sufficiently illuminate a room.

Therefore, it is an object of this invention to provide a light assembly for securing to a ceiling fan which provides sufficient light to room.

It is another object of the present invention to provide a light assembly for securing to a ceiling fan which provides an illuminating unit which can sufficiently illuminate a large room.

Further, it is another object of the present invention to provide a light assembly for securing to a ceiling fan which illuminates a room in a consistent manner.

DISCLOSURE OF THE INVENTION

Other objects and advantages will be accomplished by the present invention which provides a light assembly which can be secured to a portion of a ceiling fan for sufficiently illuminating a room. The light assembly of the present invention includes a plurality of support arms, the first ends of which are secured to a portion of a ceiling fan via a securing device. The second ends of each of the support arms supports an illuminating unit.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A light assembly for securing to an existing ceiling fan incorporating various features of the present invention is illustrated generally at 10 in the figures. The light assembly 10 is designed to provide more extensive illumination than a traditional ceiling fan which is equipped with a light assembly. Moreover, in the preferred embodiment, the light assembly 10 is designed to provide decorative effect.

Figure 1:
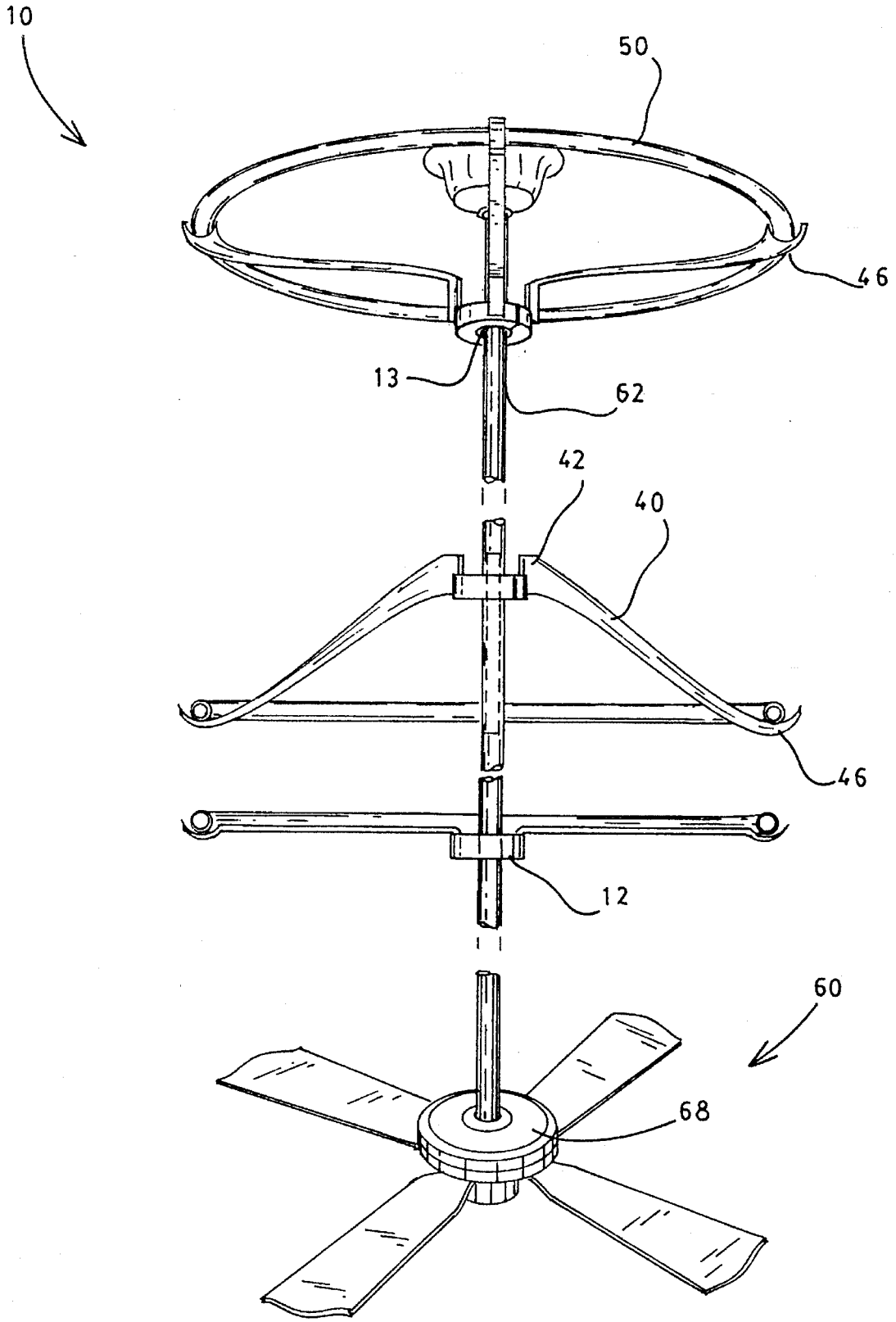
FIG. 1 is a perspective view of the light assembly for securing to a ceiling fan constructed in accordance with several features of the present invention.

The light assembly 10 of the present invention is configured to secure to an existing ceiling fan 60. A conventional ceiling fan 60 is suspended from a ceiling, as shown in FIG. 1. The electrical box which powers the ceiling fan 60 is mounted in the ceiling. The ceiling fan motor 68 which rotates the blades 66 is in electrical communication with the electrical box in the ceiling.

The light assembly 10 is generally comprised of a securing device 11 for securing the first end 42 of a plurality of support arms 40 to an existing ceiling fan 60, the second end 46 of each of the support arms 40 supports an illuminating unit 50.

Figure 4:
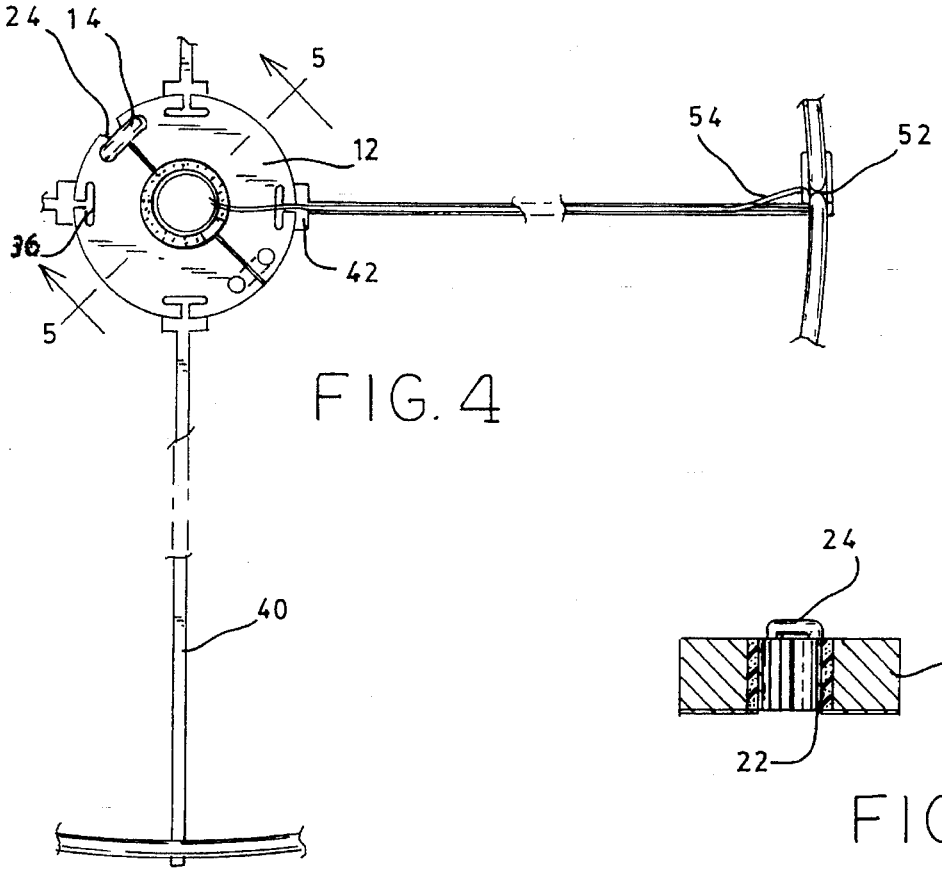
FIG. 4 illustrates top view of the collar and support arms.
Figure 5:
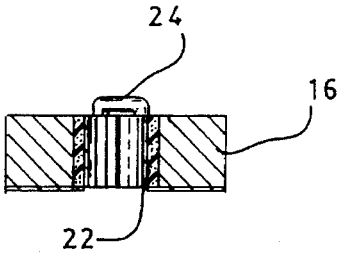
FIG. 5 illustrates a cross sectional view of the collar taken along line 5—5 of FIG. 4.
Figure 2:
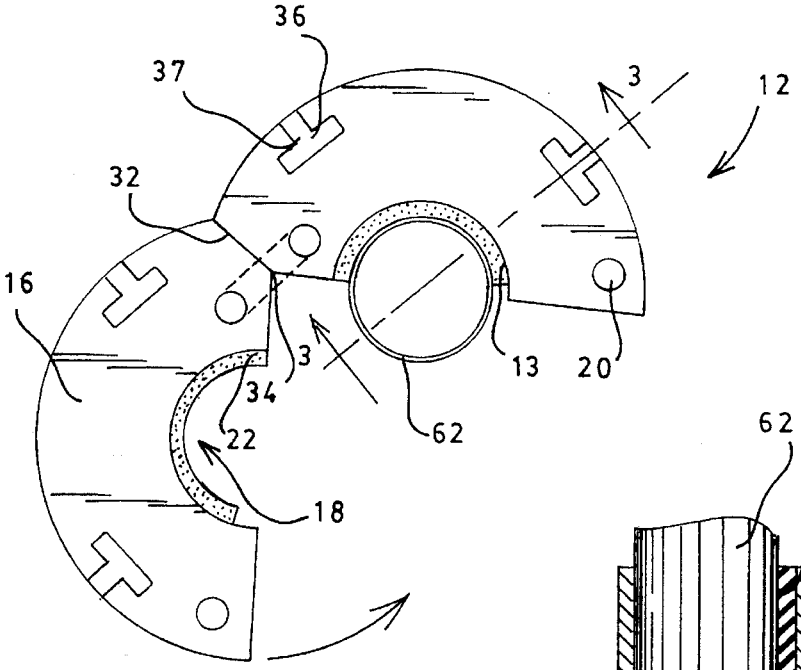
FIG. 2 illustrates a top view of the collar.
Figure 3:
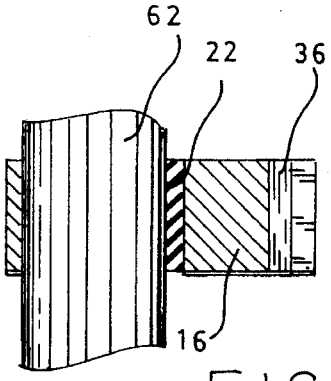
FIG. 3 is a cross sectional view of the collar taken along line 3—3 of FIG. 2.

In the embodiment shown in FIG. 1, the securing device 11 is a collar 12 which generally defines a fastening means 14 for fastening the collar 12 around the shaft 62 of a ceiling fan 60, and a plurality of slots 36 which are configured to receive the first end 42 of each of the support arms 40. In the embodiments shown in FIG. 1, the collar 12 is secured to the shaft 62 via a compression-type bushing 22 carried at the inner surface 13 of the collar 12. In the preferred embodiment, the collar 12 is comprised of two substantially arcuate plates 16, as shown in FIG. 2. Each plate 16 defines an inner recess 18 which carries the bushing material 22. Further, in this embodiment, the plates 16 of the collar 12 are secured around the shaft 62 by inserting a U-shaped bolt 24 though openings 20 defined by each of the plates 16. The openings 20 align and are able to receive the U-bolts 24, upon alignment of the two plates 16. In the preferred embodiment, each of the plates 16 defines a pivot edge 32. A U-bolt 24 is inserted into the openings 20 defined proximate each of the pivot edges 32. In this manner, the two plates 16 of the collar 12 can pivot relative to a pivot point 34, as shown in FIG. 2. With this embodiment, the collar 12 can be easily secured around the shaft 62 by positioning one plate 16 around the shaft 62, as shown in FIG. 3, and securing the second plate 16 thereto such that the two plates 16 surround the shaft 60. Another U-bolt 24 is inserted into the aligned openings 20 opposite the pivot point 34, as shown in FIG. 4, to securely mount the collar 12 on the shaft 62. FIG. 5 illustrates a cross-sectional view of the collar 12 positioned around the shaft 62 in this manner. The bushing material 22 is frictionally positioned against the shaft 62 to maintain the collar 12 at the desired location.

Figure 6:
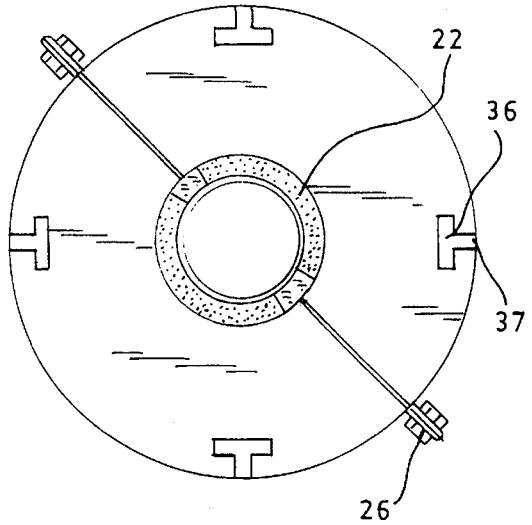
FIG. 6 is a top view of an alternate embodiment of the collar.

FIG. 6 shows an alternate embodiment of the fastening means 14 for securing the collar 12 around the shaft 62. As in the embodiment described above, a bushing material 22 is carried in the inner surface 13 of the collar 12. In this embodiment, each of the arcuate plates 16 carries an extension 26 on each end. The extensions 26 are bolted together when they are aligned.

Figure 7:
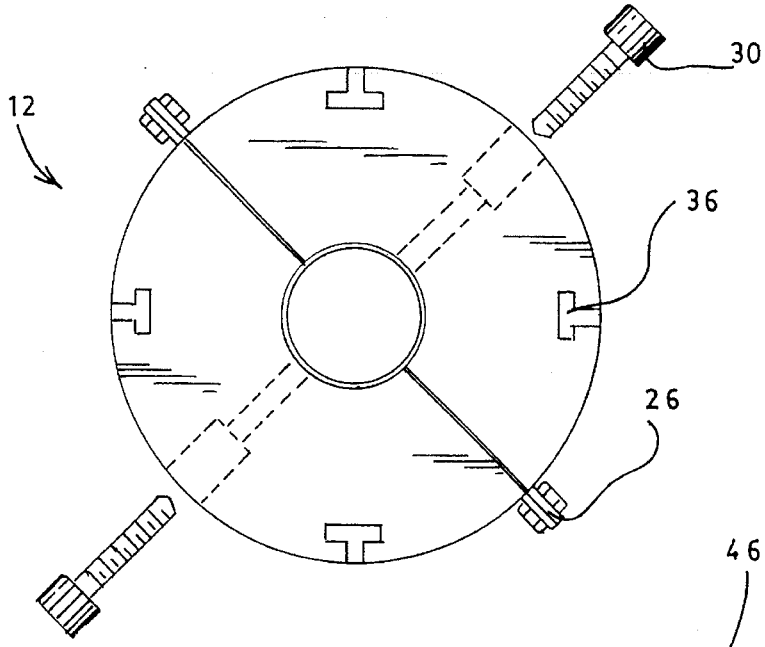
FIG. 7 is a top view of an alternate embodiment of the collar.

FIG. 7 shows a second alternate embodiment of the fastening means 14 for securing the collar 12 to the shaft 62 of a ceiling fan 60. This embodiment is similar to FIG. 6 in that each plate 16 carries an extension 26 which is bolted to the corresponding extension 26 of the opposite plate. Once the collar 12 is set around the shaft 62, two oppositely disposed set screws 30 are secured through the plates 16 and into the shaft 62.

It will be noted that any means for securing the collar 12 around the shaft 62 such that the collar 12 does not slip will be appropriate.

The collar 12 defines a plurality of slots 36, each of which is configured to receive the first end 42 of a support arm 40. The slots 36 are equally spaced around the collar 12, as shown in FIGS. 2 and 4. It is preferable that the collar 12 include four slots 36 into which four support arms 40 can be received.

Figure 10:
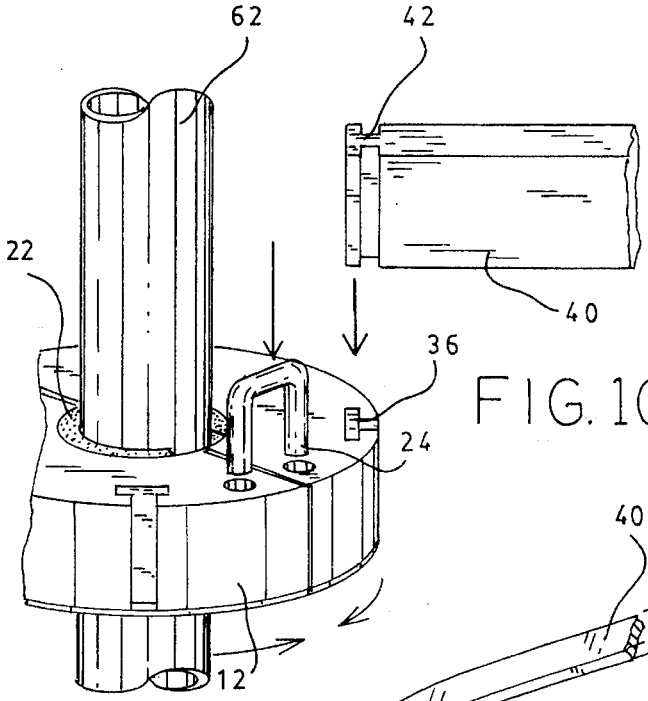
FIG. 10 is a partial side elevation view of yet another embodiment of the support arm.
Figure 8:
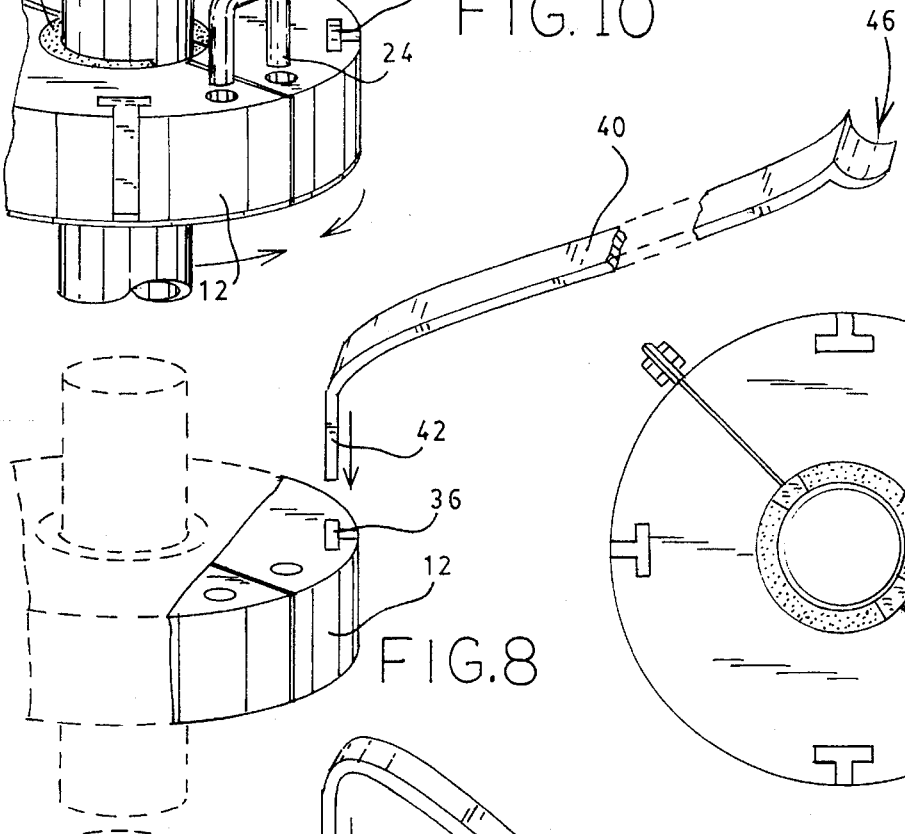
FIG. 8 is a partial side elevation view of one embodiment of the support arm.
Figure 9:
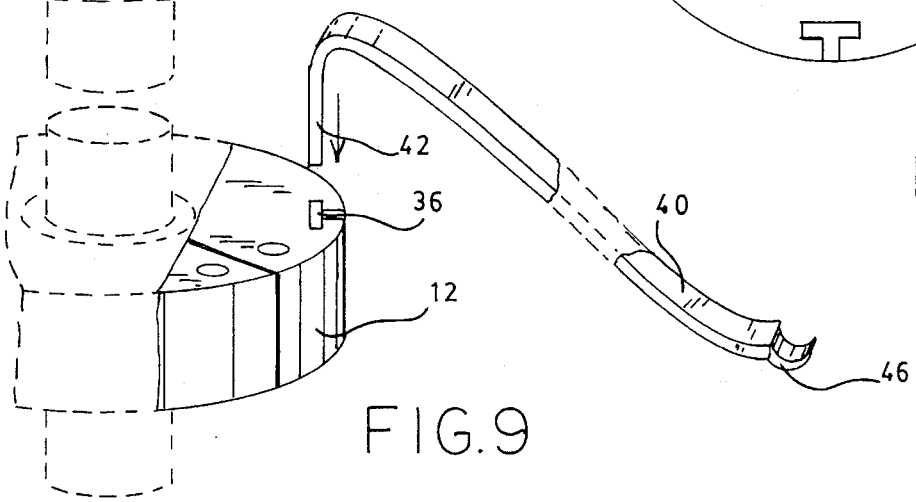
FIG. 9 is a partial side elevation view of another embodiment of the support arm.

Each of the support arms 40 defines a first end 42 and a second end 46. The first end 42, as discussed above, is configured to be securely received within a slot 36 of the collar 12. FIG. 1 and FIGS. 8, 9 and 10 depict first end 42 configurations which are suitable for securing each of the support arms 40 in a respective slot 36. One embodiment for the first end 42 is shown in FIGS. 8 and 9 wherein the first end 42 defines a slatted configuration. The first end 42 configuration depicted in FIG. 10 shows a slotted configuration which is received in the slot 36 and key portion 37 of the collar 12. Either of the end configurations shown are suitable for securing the first end 42 of each of the support arms 40 in the collar 12.

The second end 46 of each of the support arms 40 defines a configuration for securely supporting an illuminating unit 50. A number of embodiments are acceptable. It is preferable that the second end 46 of each support arm 40 define a substantially U-shaped configuration for supporting the illuminating unit 50. The second end 46 configurations shown in FIGS. 8 and 9 support a smaller portion of illuminating unit 50 at the support arm 40 than the second end configurations of the embodiments shown in FIG. 1. It will be noted that any embodiment which supports the illuminating unit 50 is suitable.

FIG. 1 illustrates three alternate embodiments for the support arms 40 which extend in a substantially radial manner away from the collar 12. In a first embodiment, shown in FIG. 8, the support arms 40 are configured to extend upward above the collar 12. In the second embodiment, shown in FIG. 9, the support arms 40 are configured to extend downward below the collar 12. In the third embodiment, shown in FIG. 10, the support arms 40 are configured to extend away from the collar 12 such that the support arms 40 are substantially level with the collar 12. The embodiment chosen will determine the height relative to the fan blades 66 at which the illuminating unit 50 will be supported.

The illuminating unit 50 supported by the support arms 40 is preferably circular in configuration and the diameter of the illuminating unit 50 is approximately the diameter of the fan blade rotation, as shown in the Figures. The circular configuration of the illuminating unit 50 allows for illumination of a larger portion of a room and is in keeping with the circular rotation of the fan blades 66. In the preferred embodiment, the illuminating unit 50 is a circular neon bulb. The bulb is powered in a typical manner. As shown in FIG. 4, an electrical cable 54 extends from the electrical box 52 of the illuminating unit 50 to the main body of the ceiling fan 60. In the preferred embodiment, the cable 54 is inserted into the shaft 62 of the ceiling fan 60 and is run up the interior of the shaft 62. Subsequently, the cable 54 is electrically wired to the electrical box within the ceiling (not shown). It is preferable that the electrical cable 54 is secured to the support arm 40 along which the cable 54 extends. It will be noted that the illuminating unit 50 can be fluorescent, incandescent, neon or any other suitable light source.

In an alternate embodiment, a rheostat can be included within the electrical wiring of the bulb to control the brightness or dimness of the bulb.

Of course, it will be noted that the support arms can be longer or shorter such that the circumference of the light assembly is, respectively, larger or smaller than the circumference of the fan blades.

Figure 11:
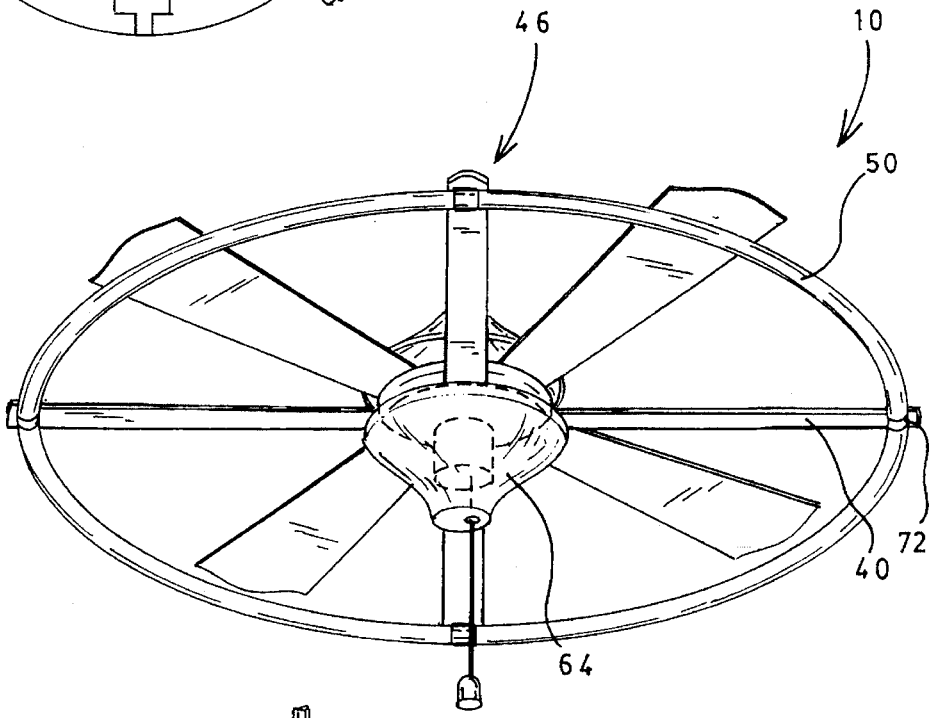
FIG. 11 is a perspective view of an alternate embodiment of the light assembly of the present invention.
Figure 12:
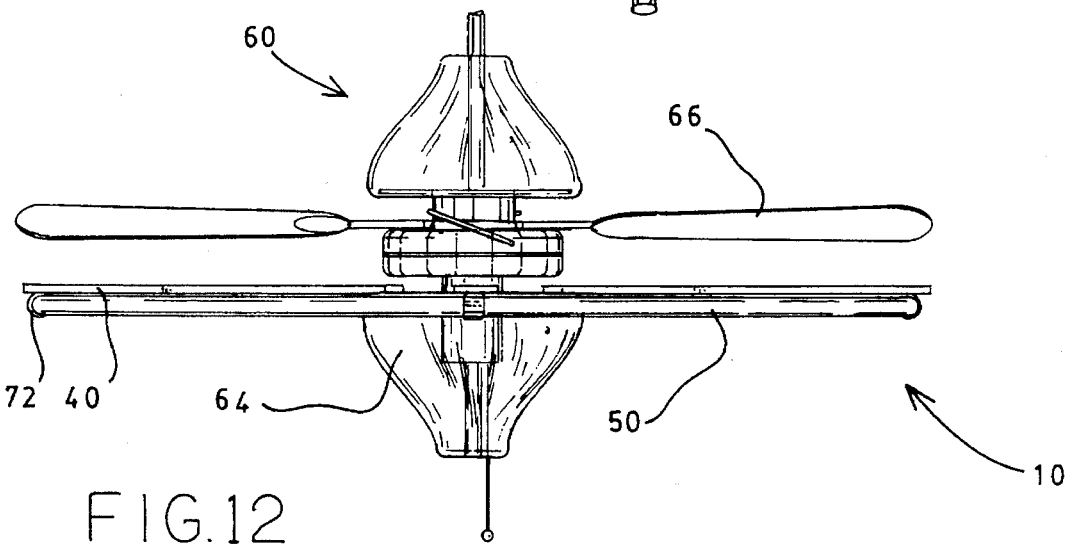
FIG. 12 is a side elevation view of the alternate embodiment of FIG. 11.

Alternate embodiments of the light assembly 10 are shown in FIGS. 11–17. The light assembly 10 is adapted to fit to a ceiling fan 60 without an available shaft to which the collar can be secured, as shown in FIG. 12. The ceiling fan 60 depicted in FIGS. 11–15 is a conventional ceiling fan 60 with opposing domes 64 which provide a decorative effect. In the alternate embodiment shown in FIGS. 11–17, the securing device 11 is a plurality of screws 56 utilized to secure the support arms 40 directly to the upper surface 65 of the lower dome, as shown most clearly in FIG. 15.

Figure 13:
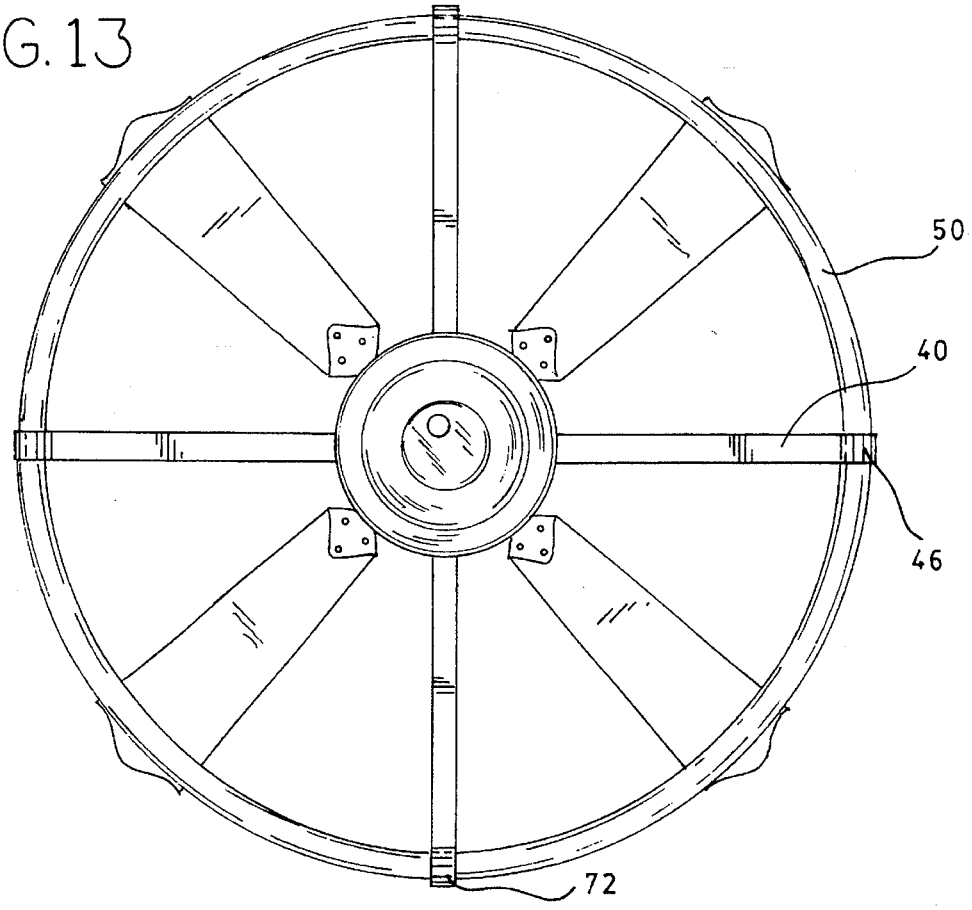
FIG. 13 is a plan view of the alternate embodiment of FIG. 11.
Figure 15:
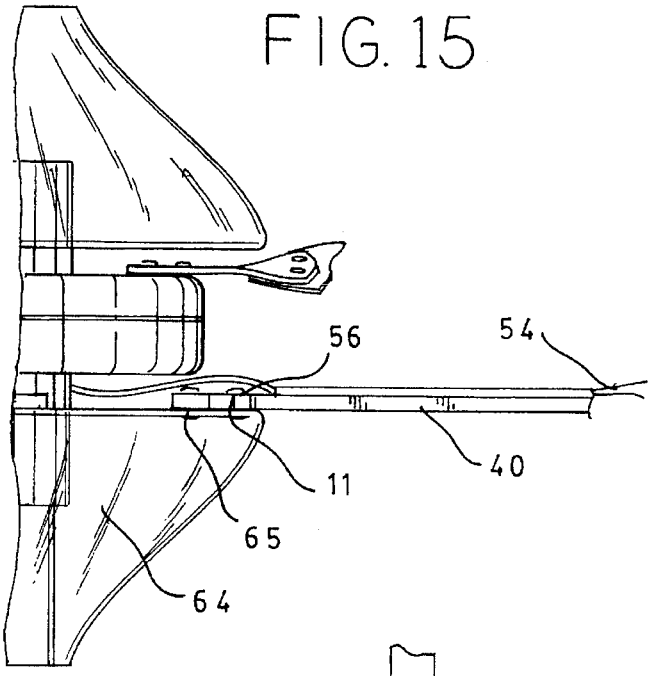
FIG. 15 is a partial side view of the support arm for the light assembly of FIG. 11 and FIG. 14.
Figure 16:
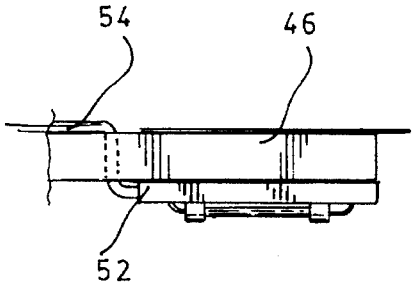
FIG. 16 is side view of the illuminating unit for the alternate embodiment of FIG. 14.
Figure 17:
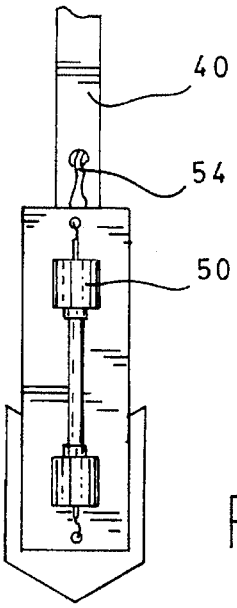
FIG. 17 is a top view of the illuminating unit of FIG. 16.

In the alternate embodiment shown in FIGS. 11–13, the first end 42 of the four support arms 40 are secured to the lower dome as described above. The illuminating unit 50 is secured in place at the second end 46 of each support arm 40. In the preferred embodiment, the illuminating unit 50 is secured to the bottom of the second ends 46 with a bracket 72. It will be noted that the illuminating unit 50 can also be secured to the top of the second ends 46. The electrical cable 54 leads from the illuminating unit 50 to the main body of the ceiling fan 60, as shown in FIG. 15. The electrical cable 54 is preferably run up the interior of the center shaft and electrically wired in the electrical box in the ceiling. The electrical cable 54 is preferably secured to the support arm 40 along which the cable 54 extends.

In an alternate embodiment (not shown), an electrical outlet, with which the illuminating unit is capable of communicating, is incorporated into the ceiling fan such that a DC powered device such as a generator can be plugged into the outlet thereby powering the illuminating unit.

Figure 14:
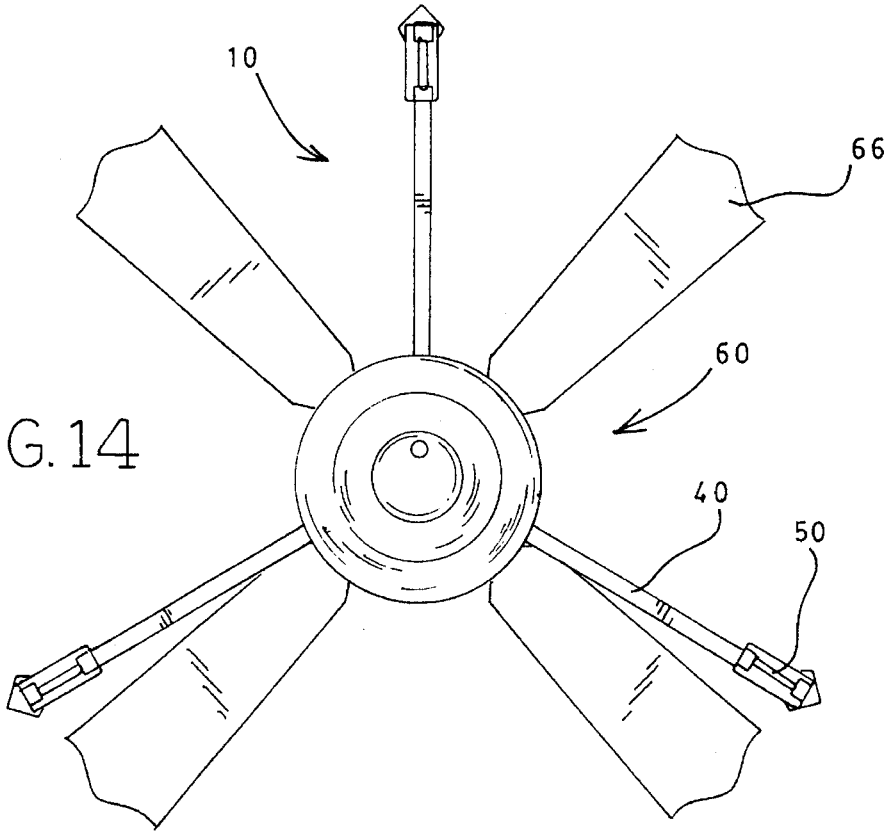
FIG. 14 is a plan view of an alternate embodiment of the light assembly of the present invention.

In the alternate embodiment shown in FIG. 14, each of the second ends 46 of the support arms 40 carries an individual light source and most preferably a halogen light bulb. In the preferred embodiment, the illuminating unit 50 is secured to the underside of the respective support arm 40. Each illuminating unit 50 is wired into the ceiling electrical box in the same manner as described above. The cable 54 leading from the light source electrical box 52 is run up through the interior of the shaft and into the ceiling electrical box. The electrical cable 54 is secured to the support arm 40 along which it extends.

From the foregoing description, it will be recognized by those skilled in the art that a light assembly for securing to a ceiling fan offering advantages over the prior art has been provided. Specifically, the light assembly provides sufficient illumination to a room and illuminates a large portion of a room. Further, the light assembly does not rotate thereby providing consistent illumination to a room.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A light assembly for securing to an existing ceiling fan, said light assembly comprising:

a securing device being configured to secure to a portion of the ceiling fan;

a plurality of support arms radially extending from said securing device, each of said plurality of support arms defining a first end and a second end; and an illuminating unit a portion of which being supported by each said second end of each of said plurality of support arms, said illuminating unit being substantially circular, said illuminating unit having a diameter substantially equal to the diameter of the rotation of the ceiling fan.

* * * * *